US005318097A

United States Patent [19]

Blin et al.

[11] Patent Number: 5,318,097

[45] Date of Patent: Jun. 7, 1994

[54] CASSETTE FOR FORMING AN END CLOSING SIDE OF A DEVICE FOR CONTINUOUSLY COATING LIQUID METAL

[75] Inventors: Philippe Blin, Lorry-lès-Metz; Patrice Rahier, Metz; Jacques Spiquel, Montigny-lès-Letz, all of France

[73] Assignees: Usinor Sacilor, Puteaux, France; Thyssen Stahl Aktiengesellschaft, Duisbourg, Fed. Rep. of Germany

[21] Appl. No.: 888,283

[22] Filed: May 26, 1992

Related U.S. Application Data

[63] Continuation of Ser. No. 542,877, Jun. 25, 1990, abandoned.

[30] Foreign Application Priority Data

Jun. 26, 1989 [FR] France ..... 89 08481

[51] Int. Cl.[5] ..... B22D 11/06

[52] U.S. Cl. ..... 164/428; 164/435; 164/412

[58] Field of Search ..... 164/428, 435, 480, 412, 420

[56] References Cited

U.S. PATENT DOCUMENTS

| | | | |
|---|---|---|---|
| 3,730,254 | 5/1973 | Namy | 164/428 |
| 4,754,802 | 7/1988 | Yamauchi | 164/428 |
| 4,754,804 | 7/1988 | Yukumoto | 164/428 |
| 5,010,948 | 4/1991 | Blin | 164/428 |
| 5,027,888 | 7/1991 | Sakaguchi | 164/428 |

FOREIGN PATENT DOCUMENTS

| | | | |
|---|---|---|---|
| 0222978 | 5/1987 | European Pat. Off. . | |
| 2528741 | 12/1983 | France . | |
| 2628993 | 9/1989 | France | 164/428 |
| 60-130450 | 7/1985 | Japan | 164/428 |
| 60-166146 | 8/1985 | Japan | 164/428 |
| 61-49755 | 3/1986 | Japan | 164/428 |
| 62-77155 | 4/1987 | Japan | 164/480 |
| 62-156052 | 7/1987 | Japan | 164/480 |
| 63-36955 | 2/1988 | Japan | 164/428 |

OTHER PUBLICATIONS

Patent Abstracts of Japan, —JP-A-57 130 743 Aug. 1982.

Patent Abstracts of Japan —JP-A-63 026 242 Feb. 1988.

Patent Abstracts of Japan —JP-A-63 026 243 Feb. 1988.

*Primary Examiner*—Paula A. Bradley
*Assistant Examiner*—Rex E. Pelto
*Attorney, Agent, or Firm*—Cushman, Darby & Cushman

[57] ABSTRACT

A cassette for a device for continuously casting liquid metal between two parallel rolls, the cassette includes a metal case which has a lateral wall and is open on a side of the case, and plate of refractory material which may be preheated before casting the liquid metal. The refractory plate is preshaped in such a manner so to define a free space between the periphery of the plate and the lateral wall of the case. The cassette is provided with an arrangement for fixing and gripping the plate and exerting an elastically yieldable opposing action allowing free expansion of the plate within the case.

11 Claims, 3 Drawing Sheets

CASSETTE FOR FORMING AN END CLOSING SIDE OF A DEVICE FOR CONTINUOUSLY COATING LIQUID METAL

This is a continuation of application Ser. No. 07/542,877, filed on Jun. 25, 1990, which was abandoned upon the filing hereof.

The present invention relates to a cassette for forming an end closing side of a device for continuously casting liquid metal, in particular liquid steel, between two parallel rolls.

It is known that cassettes of this type comprise a metal case which is open on one of its sides and consequently has a C-shaped section and in which is disposed a plate of refractory material which may be preheated before casting the liquid metal.

One of the faces of the refractory plate or block therefore bears against the inner end wall of the case while the opposite face is in contact with the liquid metal. When casting, the refractory plate heats up in contact with the molten metal and therefore expands. As the refractory plate is restrained in the rigid and cooler case surrounding it, it has a tendency to become deformed by buckling and therefore loses its planarity by bulging, which has an adverse effect on the fluidtightness between the plate and the end faces of the rolls. It is then found that the liquid metal sometimes infiltrates between the end faces of the rolls and the closing cassettes.

Furthermore, the inner end wall of the case is usually apertured so as to permit the preheating of the refractory plate by means of a burner. The preheating of the refractory plate before casting is carried out on its outer face so as to avoid deterioration of the surfaces of the rolls by the heating means. This preheating is desirable in order to bring the refractory material to the required temperature and avoid an excessively rapid solidification of the cast metal on contact with the refractory material at the beginning of the casting. It moreover avoids excessively sudden thermal shocks on the first contact with the liquid metal.

But this preheating results in a difference of temperature between the surface of the refractory material directly subjected to the heating and the opposite cold surface thereof, which causes a bending or a bulging of the whole of the cassette even before casting starts. In this case, the fluidtightness between the refractory plate and the end surfaces of the rolls is impaired at the start of the casting. This deformation due to the differential expansion of the two faces of the refractory plate is on principle absorbed in the course of the casting after the desired temperature has been reached owing to the fact that the refractory plate is then heated on the inner face of the plate by the cast metal, which has for effect to more or less compensate for the deformation initially produced by the preheating. Nonetheless, the overall expansion of the refractory plate still occurs and the problem of the buckling of this plate due to the fact that it is restrained in its case also still exists.

An object of the invention is therefore to overcome this problem by providing a cassette which is so arranged as to allow the free expansion of the refractory plate and thereby avoid at least the deformations due to the buckling.

According to the invention, the refractory plate is so preshaped as to leave a free space between its periphery and the lateral wall of the case, and the cassette is provided with means for fixing and gripping the refractory plate and exerting an elastically yieldable opposing action allowing a free expansion of the refractory plate within the case when the plate is heated.

It will easily be understood that the fact of permitting this free expansion limits the bulging of the refractory plate which is liable to result in infiltrations of liquid metal owing to a reduction in the area of contact between the rolls and the cassette. Indeed, this result is obtained owing to the fact that the planarity of the face of the refractory plate facing toward the liquid metal is maintained. This maintenance of the planarity and consequently the fluidtightness with respect to the liquid metal is itself closely related to the possibility of free expansion of the refractory plate in directions parallel to the plane of its inner face. Deformations due to possible differential expansions cannot be completely eliminated; but, as has been previously shown, these deformtions are at least partly absorbed when the temperature is stabilized.

Furthermore, the elasticity of the means for fixing the refractory plate also ensures the maintenance of the latter in the event of the case expanding more than the refractory plate.

According to an embodiment of the invention, said fixing and gripping means comprise screws extending through the peripheral lateral wall of the case and provided at their ends with elastically yieldable elements, such as Belleville washers, fixed to the refractory plate.

Further features and advantages of the invention will be apparent from the following description with reference to the accompanying drawings which illustrate an embodiment of the invention by way of a non-limitative example.

Figure 1:
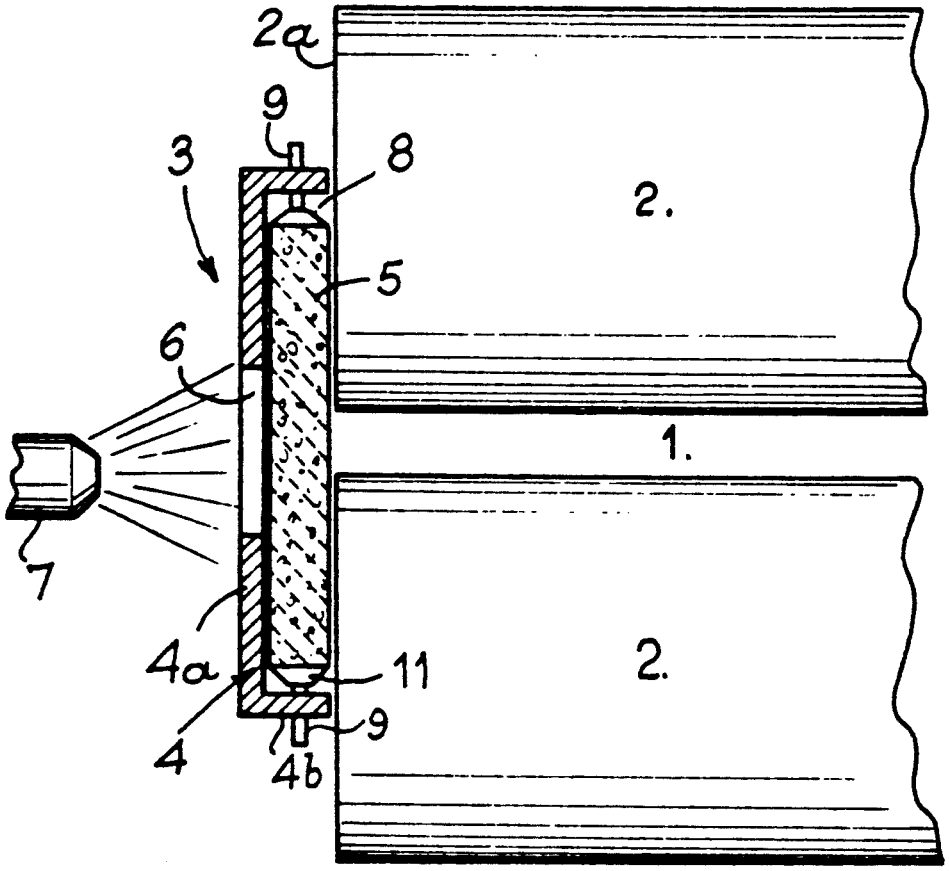
FIG. 1 is a simplified partial to,,) view of a device for continuously casting liquid metal between two rolls and one of its closing cassettes placed at the ends of the device.
Figure 3:
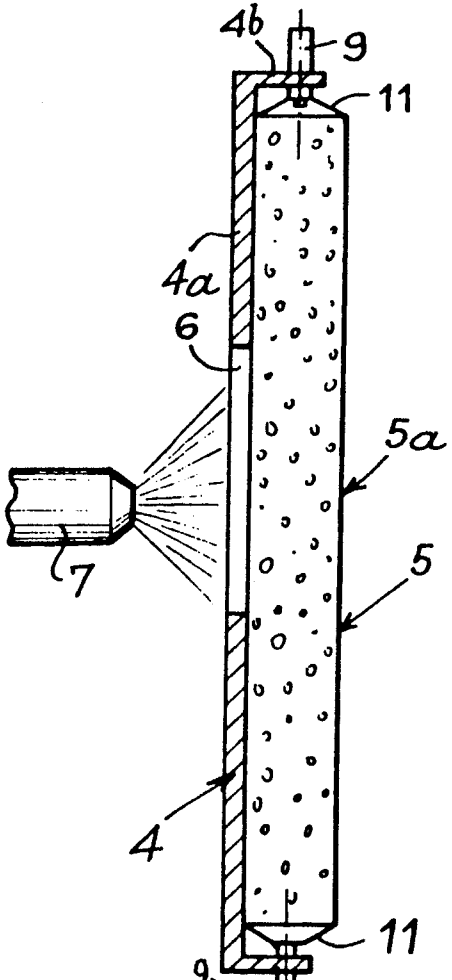
FIG. 3 is a sectional view taken on line 3—3 of FIG. 2.

FIG. 1 shows a device for continuously casting liquid metal in a free space 1 left between two parallel rolls 2 whose end faces 2*a* are contained in a common vertical plane. Such a device is known per se and needs no detailed description.

At each end of the roll 2, the space 1 is closed by a cassette 3 comprising a dish-shaped, rigid, and if desired cooled, metal case 4 open on the side thereof facing toward the rolls 2, and a refractory plate or block 5 disposed within the case 4.

The case 4 has a rectangular contour in the illustrated embodiment, an inner end wall 4*a* parallel to the end faces 2*a*, and a peripheral lateral wall 4*b* bent at right angles and dimensioned to receive the plate 5. The inner wall 4*a* is provided with a central opening 6 uncovering a corresponding part of the refractory plate 5 which must be preheated by means of a burner 7.

Figure 2:
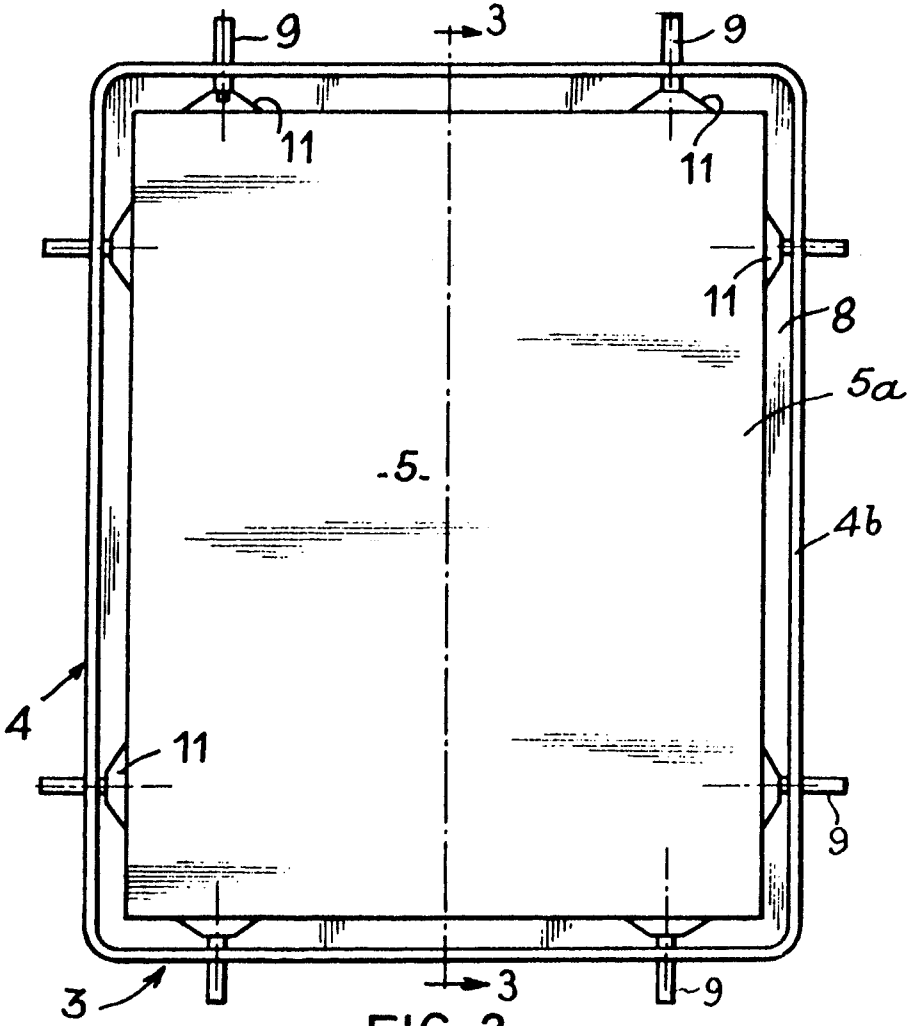
FIG. 2 is an enlarged elevational view of the cassette of FIG. 1 on the refractory plate side.

The refractory plate 5 is preshaped in such manner as to leave a free space 8 between its periphery and the peripheral wall 4*b* of the case 4 (the plate 5 being therefore rectangular in this embodiment). In addition, the cassette 3 is provided with means for fixing and gripping the refractory plate 5 within the case 4. In the represented embodiment, these means comprise a series of screws 9 extending through the peripheral wall 4b and provided at their ends with elastically yieldable elements 11 which bear against and are fixed to the edges of the refractory plate 5. These elastically yieldable elements 11 may be advantageously Belleville washers arranged, together with the corresponding screws 9, in a suitable number around the plate 5, for example two elements per side (FIG. 2).

The heating of the refractory plate 5 by the burner 7 or by the contact of the molten metal causes a free expansion of the plate 5 in the free volume 8. The Belleville washers 11 exert on the edges of the plate 5 an elastically yieldable opposing action while allowing the expansion of the plate in directions parallel to the general plane of the plate and to the common plane of the end faces 2a. Owing to this free expansion within the metal case 4, the refractory plate 5 is no longer subject to buckling and the inner face 5a of the plate 5 substantially conserves its planarity, which permits obtaining and maintaining the desired fluidtightness between the end faces 2a and this inner face 5a. In this way, any risk of infiltration of liquid metal is substantially avoided between the faces 5a and 2a during the casting.

Figure 5:
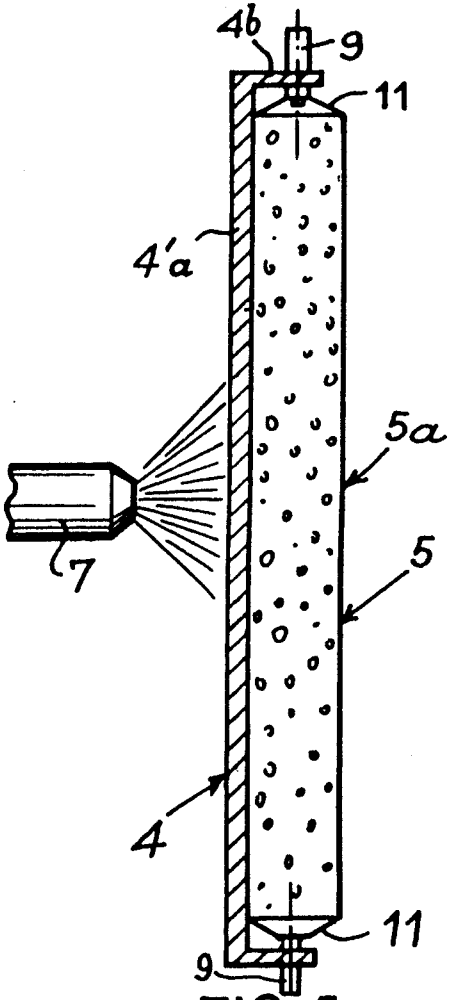
FIG. 5 is a sectional view taken along line 5—5 of FIG. 4.
Figure 4:
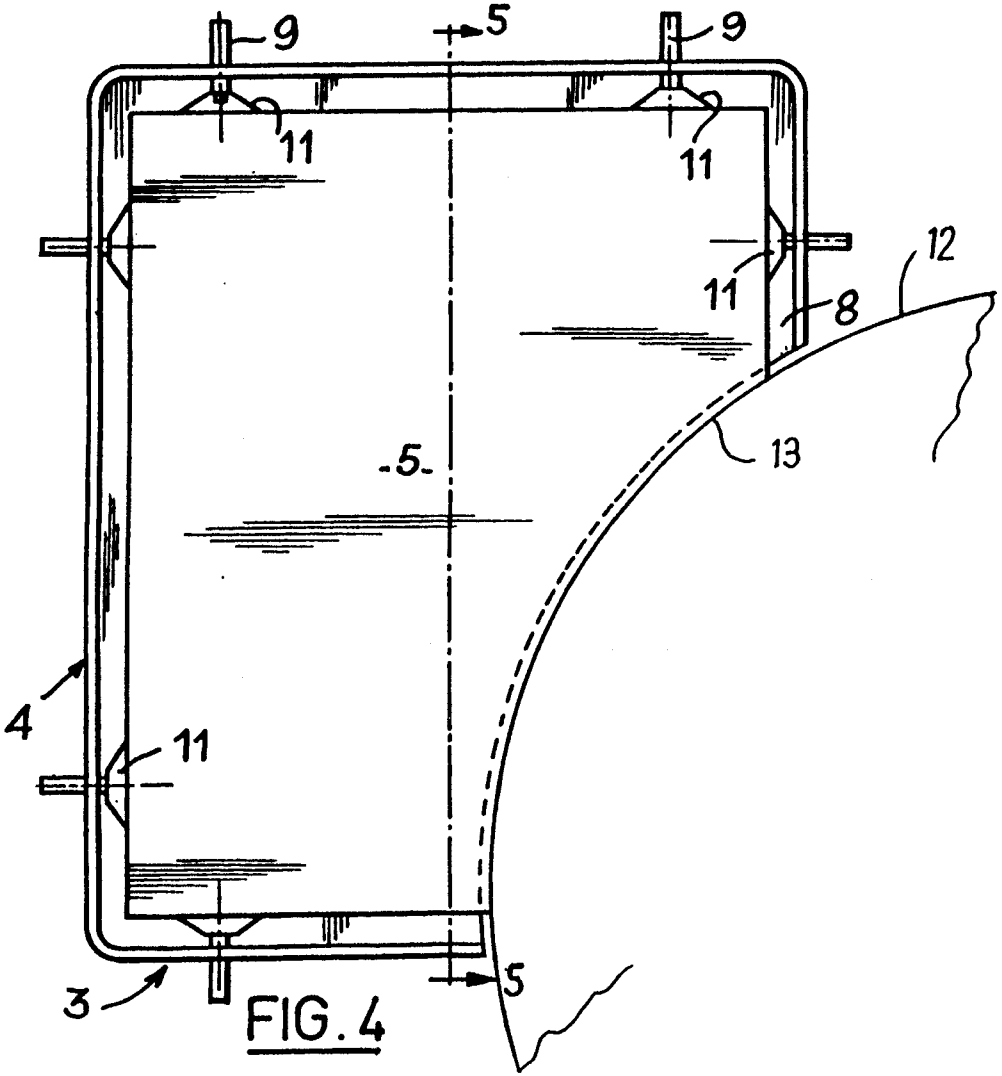
FIG. 4 is an enlarged elevation view of a second embodiment of the cassette.

As a variant as shown in FIG. 5, inner end wall 4a of the case 4 is not apertured and is therefore formed by a solid sheet if the preheating is carried out by radiation. The inner end wall 4a' then performs the function of a heat diffuser which homogenizes the supply of heat to the preheated refractory plate 5.

The scope of the invention is not intended to be limited to the arrangement described hereinbefore as an example.

In particular, the invention is also applicable to the case where the lateral wall 4b of the case 4 is not continuous and has only three sides. This arrangement is of utility in particular in the case where the end faces 2a of the rolls are axially offset from each other, the refractory plate 5 being then in contact, on one hand by its surface 5a, with the end face of one of the rolls and, on the other hand by its edge 13 located adjacent to the side where the lateral wall 4b is interrupted, with the cylindrical surface 12 of the other roll. The refractory plate is of course so shaped that edge 13 marries up with the curvature of this cylindrical surface 12.

Furthermore, the refractory plate may also include, in the region between the rolls, a projection extending between the latter or a hollow.

What is claimed is:

1. Cassette for forming an end closure for a device for continuously casting liquid metal between two parallel rolls, said cassette comprising:

a metal case having a lateral wall, said metal case being open on a side thereof, a plate of refractory material disposed within the case, the plate of refractory material being at least partially surrounded by the lateral wall so that at least two opposite parts of the lateral wall are disposed adjacent to two opposite edges of said plate, the plate being preshaped so as to leave a free space between the periphery of the plate and the lateral wall of the case, and means disposed between said opposite parts of the lateral wall of the case and said opposite edges of the plate of refractory material for fixing and gripping the plate in said cassette and exerting an elastically yieldable opposing action on said opposite edges of the plate allowing a free expansion of the plate within the case.

2. Cassette according to claim 1, wherein said fixing and gripping means comprise screws extending through said lateral wall of the case, and elastically yieldable elements provided at ends of the screws and fixed to the plate.

3. Cassette according to claim 2, wherein said metal case includes a continuous inner end wall disposed opposite said open side of said case, the cassette being preheated by radiation.

4. Cassette according to claim 1, wherein said lateral wall is discontinuous.

5. Cassette according to claim 1, wherein said metal case includes a continuous inner end wall disposed opposite said open side of said case, the cassette being preheated by radiation.

6. Cassette according to claim 3, wherein said preheating by radiation is employed on a surface of said inner end wall.

7. Cassette according to claim 5, wherein said preheating by radiation is employed on a surface of said inner end wall.

8. Cassette according to claim 1, wherein said metal case includes a continuous inner end wall disposed opposite said open side of the case.

9. Cassette according to claim 1, wherein said metal case includes an apertured inner end wall disposed opposite said open side of the case.

10. Cassette according to claim 8, wherein the cassette is preheated by radiation, said preheating by radiation being directed towards the inner end wall.

11. Cassette according to claim 9, wherein the cassette is preheated by radiation, said preheating by radiation being directed towards the inner end wall.

* * * * *